US006131499A

United States Patent [19]

Chen

[11] Patent Number: 6,131,499

[45] Date of Patent: Oct. 17, 2000

[54] HANDSAW GUIDE MEMBER OF CARPENTER'S SAW BENCH

[76] Inventor: Nick Chen, No. 64-2, Chiu Sheh Lane, Chiu Sheh, Pei Tun Area, Taichung, Taiwan

[21] Appl. No.: 09/164,576

[22] Filed: Oct. 1, 1998

[51] Int. Cl.[7] ..... B26D 1/54

[52] U.S. Cl. ..... 83/762; 83/781

[58] Field of Search ..... 83/574, 762, 781, 83/581, 763, 764, 765, 766, 767, 954

[56] References Cited

U.S. PATENT DOCUMENTS

| | | | |
|---|---|---|---|
| 187,431 | 2/1877 | Tierney | 83/763 |
| 240,737 | 4/1881 | Lewis | 83/581 |
| 646,479 | 4/1900 | Wilinson | 83/763 |
| 651,457 | 6/1900 | Dorn | 83/766 |
| 876,795 | 1/1908 | Galentine | 83/766 |
| 999,769 | 9/1911 | Fish | 83/763 |
| 1,708,641 | 4/1929 | Trepte | 83/581 |
| 3,385,330 | 5/1968 | Haynes | 83/581 |
| 3,881,386 | 5/1975 | Zimmerman | 83/762 |
| 4,226,152 | 10/1980 | Bies | 83/581 |
| 4,262,571 | 4/1981 | King et al. | 83/762 |
| 4,346,636 | 8/1982 | Taylor | 83/767 |
| 4,377,959 | 3/1983 | DeCarolis | 83/762 |
| 5,259,286 | 11/1993 | Chen | 83/581 |
| 5,392,679 | 2/1995 | Wang | 83/766 |
| 5,560,273 | 10/1996 | Keddie | 83/767 |
| 5,605,086 | 2/1997 | Huang-Mo et al. | 83/781 |
| 5,713,258 | 2/1998 | Keddie | 83/581 |
| 5,957,023 | 9/1999 | Cheng | 83/581 |

*Primary Examiner*—Rinaldi I. Rada
*Assistant Examiner*—Omar Flores
*Attorney, Agent, or Firm*—Browdy and Neimark

[57] ABSTRACT

A carpenter's saw bench is composed of a base and a rotary platform pivoted to the bottom of the base. The rotary platform is provided at both ends thereof with a guide rod set which is in turn provided with a handsaw guide member. The handsaw guide member is provided in the top thereof with a saw bow guide slot for receiving a saw bow of a handsaw, and in the bottom thereof with a saw blade receiving slot for receiving a saw blade of the handsaw. The handsaw guide member is provided in the top thereof with an indentation in communication with the saw bow guide slot, and in the bottom thereof with a slit in communication with the saw blade receiving slot. The handsaw can be detachably fastened with the handsaw guide members such that the handsaw can be separated from the saw bench to allow the handsaw to be used independently as an ordinary handsaw.

2 Claims, 4 Drawing Sheets

HANDSAW GUIDE MEMBER OF CARPENTER'S SAW BENCH

FIELD OF THE INVENTION

The present invention relates generally to a carpenter's tool, and more particularly to a handsaw guide member of a carpenter's saw bench.

BACKGROUND OF THE INVENTION

As shown in FIG. 1, a carpenter's saw bench 10 of the prior art which is intended to bevel an object is composed of a base 11 and a platform 12 which is engaged with the bottom of the base 11 and provided respectively at both ends thereof with a guide rod set 13 consisting of one guide rod or two parallel guide rods. The guide rod set 13 is provided with a guide member 14 which is in turn provided with a saw bow guiding slot 141 and a saw blade receiving slot 142. A handsaw 15 has a saw bow 16 and a saw blade 17. In view of the fact that two guiding members 14 are attached to the handsaw 15, the handsaw 15 can not be detached for use independently as a handsaw.

SUMMARY OF THE INVENTION

The primary objective of the present invention is to provide a carpenter's workbench with a handsaw guide member which can be detachably fastened with the handsaw such that the handsaw can be detached for use independently as an ordinary handsaw.

In keeping with the principle of the present invention, the foregoing objective of the present invention is attained by an improved handsaw guide member of a carpenter workbench. The handsaw guide member of the present invention is basically similar in construction to that of the prior art, except that the handsaw guide member of the present invention is provided in the top end thereof with an indentation in communication with the saw bow guiding slot, and in the bottom thereof with a slit in communication with the saw blade receiving slot. The handsaw is detachably fastened or separated with the handsaw guide member such that the handsaw can be handily detached for use independently as a handsaw without having to disassemble the handsaw. As a result, the handsaw, which is originally intended to bevel an object, can be also used as an ordinary handsaw.

DETAILED DESCRIPTION OF THE INVENTION

Figure 1:
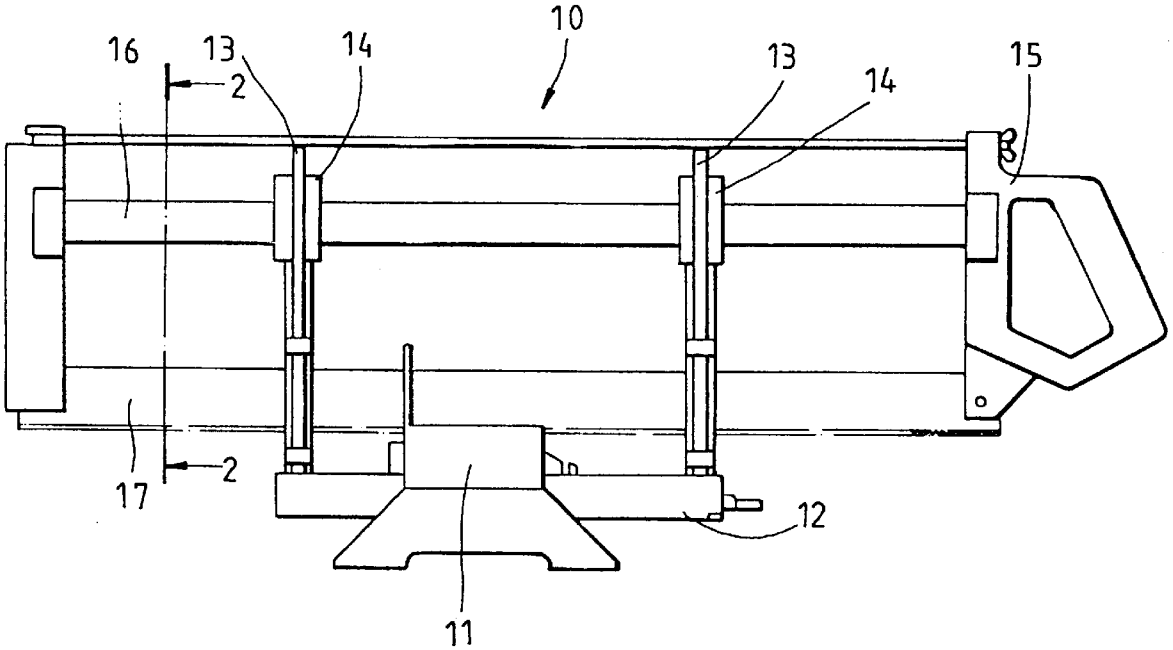
FIG. 1 PRIOR ART
FIG. 1 shows a plan view of a carpenter's handsaw bench of the prior art.
Figure 2:
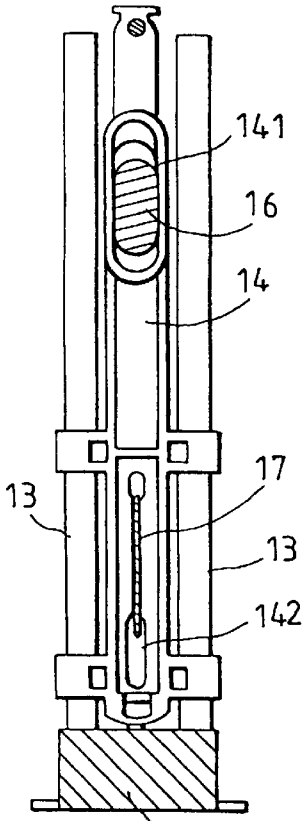
FIG. 2 PRIOR ART
FIG. 2 shows an enlarged sectional view taken along the direction indicated by a line 2—2 as shown in FIG. 1.
Figure 3:
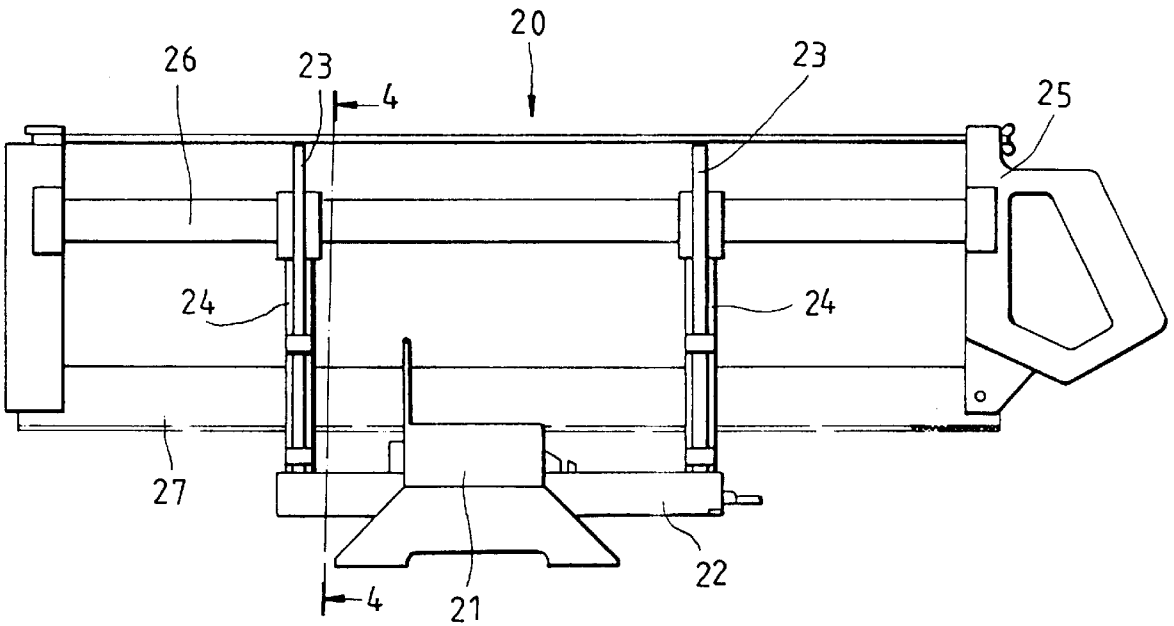
FIG. 3 shows a plan view of a carpenter's saw bench of the present invention.
Figure 4:
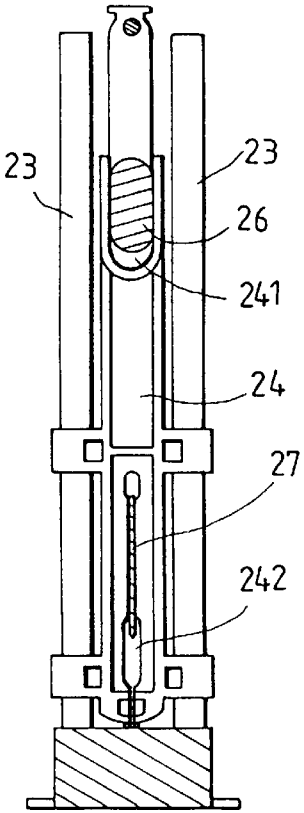
FIG. 4 shows an enlarged sectional view taken along the direction indicated by a line 4—4 as show in FIG. 3.

As shown in FIGS. 3 and 4, a carpenter's saw bench 20 of the present invention is composed of a base 21 and a platform 22 which is engaged to the bottom of the base 21. The platform 22 is provided respectively at both ends thereof with a guide rod set 23 which is in turn provided with a handsaw guide member 24. The handsaw guide member 24 is provided in the upper side thereof with a saw bow guide slot 241, and in the lower side thereof with a saw blade receiving slot 242 for receiving respectively a saw bow 26 and a saw blade 27 of a handsaw 25. The present invention is basically similar in construction to the prior art, except that each guide member 24 of the present invention is provided in the top thereof with an indentation 243 in communication with the saw bow guide slot 241, and in the bottom thereof with a slit 244 in communication with the saw blade receiving slot 242. As a result, the guide member 24 can be detachably fastened with and separated from the handsaw 25 with ease and speed, as shown in FIGS. 5 and 7.

Figure 5:
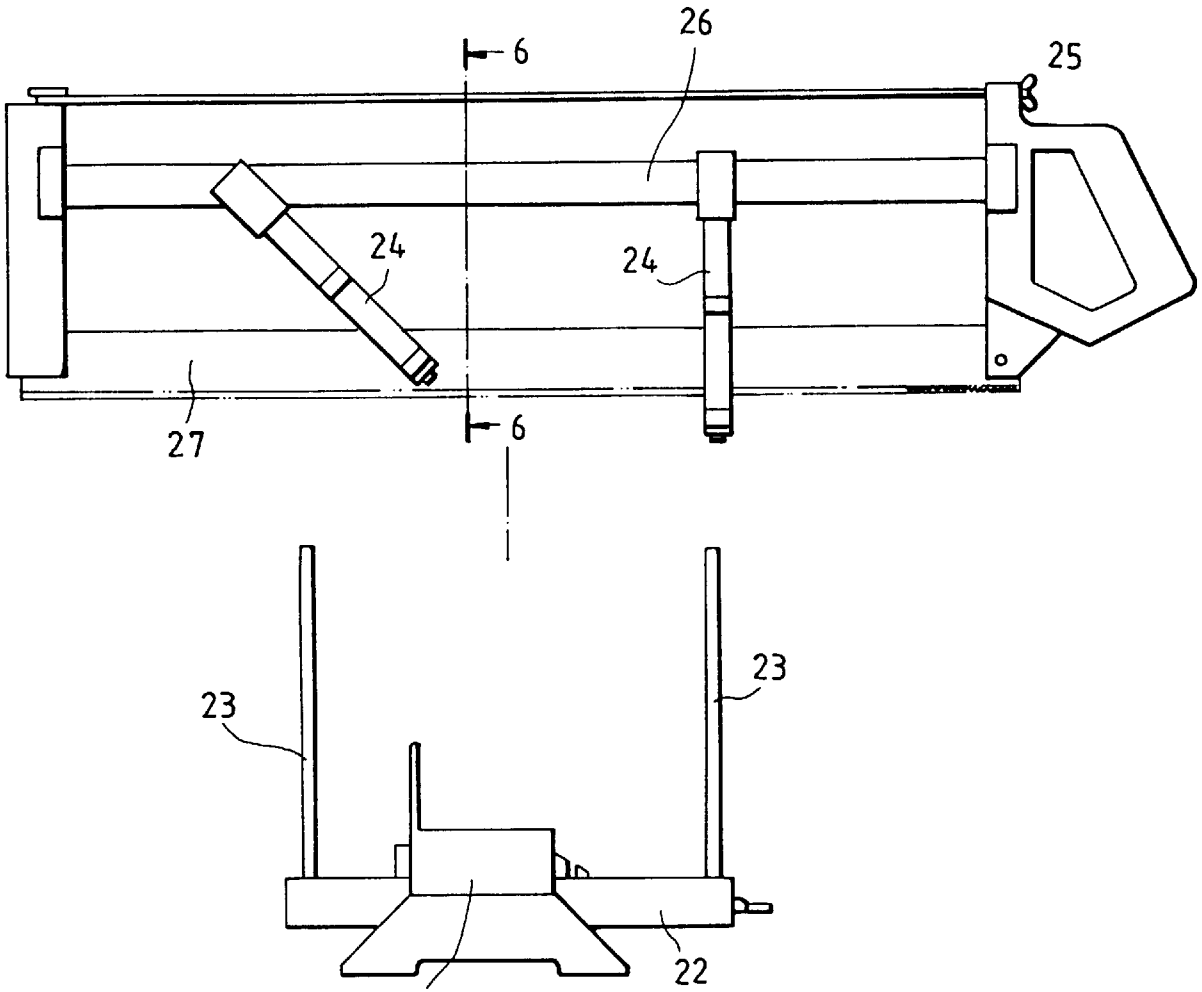
FIG. 5 is similar to FIG. 3 for showing the handsaw that is detached from the base and that one of the guiding members is slanted.
Figure 6:
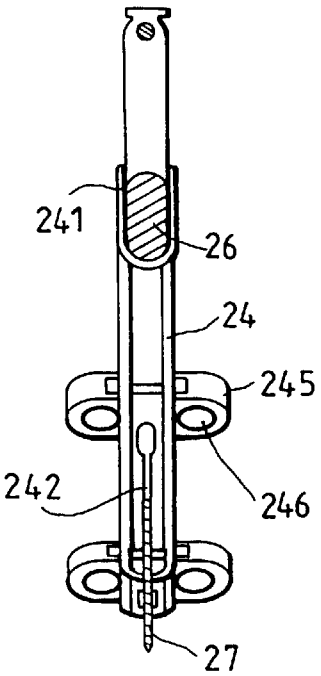
FIG. 6 shows an enlarged sectional view taken in the direction indicated by a line 6—6 as shown in FIG. 5.

As shown in FIGS. 5 and 6, the handsaw guide member 24 is provided with two lugs 245 which are located at two sides of the guide member 24 and provided with a through hole 246. The guide rods 23 are fitted into the through holes 246 of the two lugs 245. As the handsaw 25 is raised, the guide member 24 slid off of the guide rods 23 the handsaw 25 separates from the base 21. Thereafter, when guide member 24 is held by hand and the handsaw 25 inclined the saw blade 27 separates from guide member 24 via the slit 244. In the meantime, the saw bow 26 also separates from the guide member 24, thereby completing separation of guide member 24 from handsaw 25 and permitting separate use of the handsaw 25.

Figure 7:
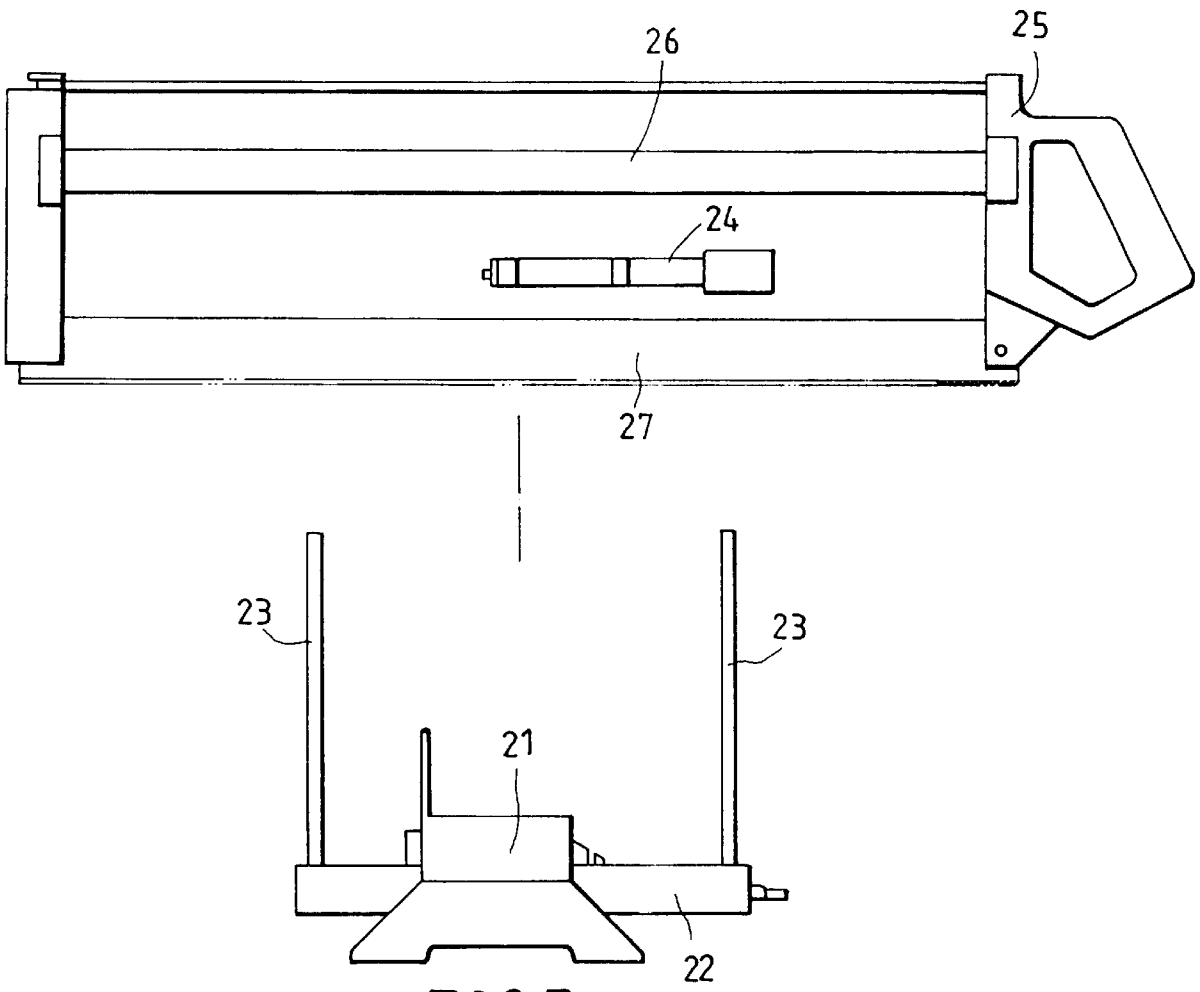
FIG. 7 is a plan view showing the detachment of the guiding member from the handsaw or the attachment of the guiding member to the handsaw of the present invention.
Figure 8:
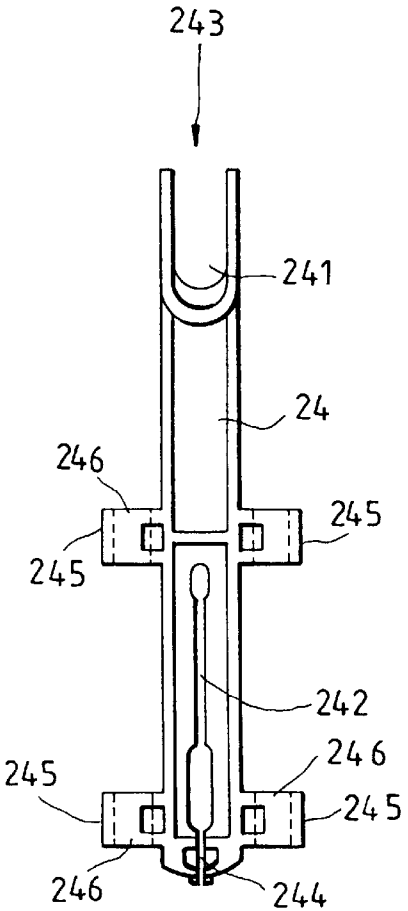
FIG. 8 shows a plan view of the guiding member of the present invention.

As shown in FIG. 7, when the saw bow 26 and the saw blade 27 are completely separated from the guide member 24, the guide member 24 is removed from the handsaw 25, which can be then used independently as an ordinary handsaw without interference from the guide member 24. The handsaw 25 can be put back in with the saw bench 20 such that the guide member 24 is once again engaged with the handsaw 25 which is ready to bevel an object.

What is claimed is:

1. A carpenter's saw bench for use with a handsaw comprising:

a base;

a platform engaged to said base;

a guide rod set fastened at each end of said platform;

a space provided between rods of each said guide rod set from said platform through free ends of said rods;

a unitary handsaw guide member slidably engaged to each said guide rod set;

each said handsaw guide member having at an upper end thereof a saw bow slot adapted to receive a saw bow of a handsaw and at a lower end thereof a saw blade receiving slot adapted to receive a saw blade of the handsaw;

wherein each said handsaw guide member is provided in a top thereof with an indentation opening upward in communication with the saw bow guide slot, and in a bottom thereof with a slit opening downward in communication with the saw blade receiving slot, wherein said handsaw and each said handsaw guide member can be separated together from said saw bench along said space between said rods; and each said handsaw guide member is separable from said handsaw by inclining each said handsaw guide member relative to said handsaw until said bow is disengaged from each said bow slot and indentation slot and said saw blade is disengaged from each said saw blade receiving slot and said slot opening; and wherein said handsaw guide member has two pairs of lugs, each pair respectively fitted over two guide rods of the guide rod set and located below said bow guide slot.

2. The carpenter's saw bench of claim 1, wherein said handsaw guide member is provided with at least two lugs each having a through hole;

wherein said handsaw guide member is slidably engaged with each said guide rod set such that each of said two through holes of said two lugs of said handsaw guide member are respectively fitted over two guide rods of the guide rod set.

* * * * *